United States Patent [19]

Thomas

[11] 4,075,414

[45] Feb. 21, 1978

[54] APPARATUS FOR REGULATING THE IMMERSION DEPTH OF ELECTRODES IN ELECTRODE-MELTING FURNACES

[75] Inventor: Friedrich Werner Thomas, Niedermittlau, Germany

[73] Assignee: Leybold-Heraeus GmbH & Co. KG, Cologne, Germany

[21] Appl. No.: 635,462

[22] Filed: Nov. 26, 1975

[30] Foreign Application Priority Data

Nov. 29, 1974 Germany ..... 2456512

[51] Int. Cl.[2] ..... F27D 11/06

[52] U.S. Cl. ..... 13/13

[58] Field of Search ..... 13/9 ES, 13

[56] References Cited

U.S. PATENT DOCUMENTS

| | | | |
|---|---|---|---|
| 3,375,318 | 3/1968 | Kjolseth et al. | 13/9 ES |
| 3,520,978 | 7/1970 | Svendsen | 13/9 ES |
| 3,665,080 | 5/1972 | Medovar et al. | 13/9 ES |
| 3,744,989 | 7/1973 | Doenecke et al. | 13/9 ES |

*Primary Examiner*—R. N. Envall, Jr.

*Attorney, Agent, or Firm*—Burgess, Dinklage & Sprung

[57] ABSTRACT

The invention relates to a system for regulating the depth of immersion of melting electrodes in electrical slag remelting furnaces, consisting of an apparatus for the detection of the resistance and for changing this resistance upon the spatial displacement of the end of the electrode within the slag layer, a signal corresponding to the resistance being relayed to a regulating system for the electrode drive.

2 Claims, 3 Drawing Figures

Figure 1:
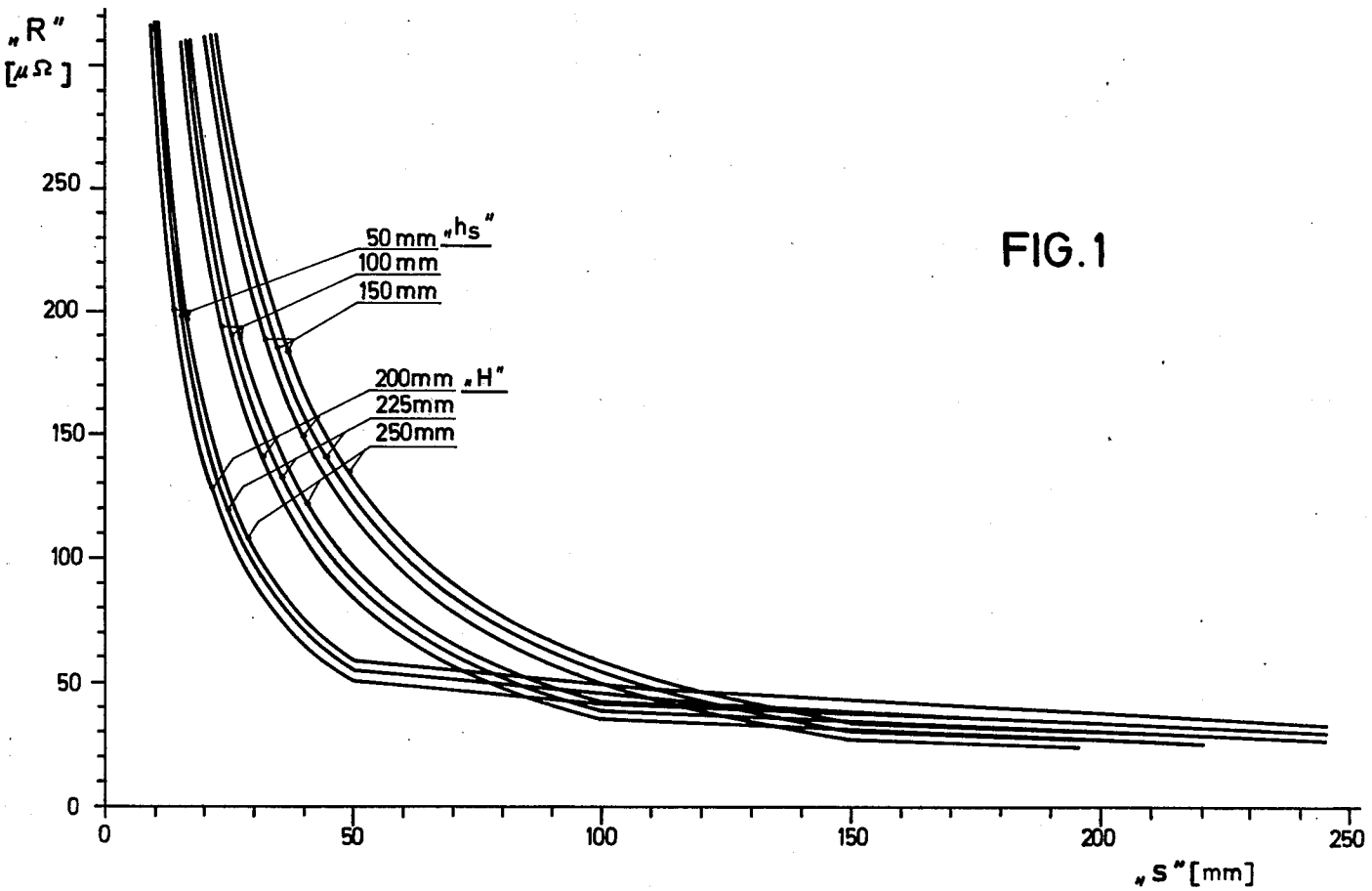

APPARATUS FOR REGULATING THE IMMERSION DEPTH OF ELECTRODES IN ELECTRODE-MELTING FURNACES

Through the article by W. Richling, "Das Elektro-Schlacken-Umschmelzen", published in "Neue Huette", Vol. 9, September 1961, pp 565 to 572, especially p 568, it is known that the depth of immersion in electrical slag remelting has a decided influence on the shape of the bottom end of the electrode and hence on the conduct of the melting. If the immersion is insufficient, arcing occurs, which can do harm (oxidation) to the metal being remelted. If the immersion is too deep, a very long, tapered electrode end is formed which, upon immersion into the metal bath, results in the "freezing in" of the electrode and in the interruption of the remelting action. The useful, stable working range is relatively narrow, so that for some time there has existed a need for a means of keeping the depth of immersion as constant as possible within the working range that has been recognized as desirable. Nevertheless, regulating methods or systems operating on an electrical basis which might be usable for this purpose have not yet been disclosed.

The method most frequently used for regulating the depth of immersion is one in which the voltage signal measured through the electrode, the slag and the ingot at constant melting current is the basis. Such a method is simple and reliable and does not involve great expense in construction. It is disadvantageous, however, that, due to the proportionality between current and voltage, in the event of variations of the melting current due to conditions caused by the process, the voltage used for controlling the depth of immersion also varies. As a result, a different depth of immersion is falsely indicated, although it is only the intensity of the melting current that is changed. Changes in the voltage reading due to the diminishing length of the melting electrode and variations of the bath resistance due to temperature, slag composition and depth of the slag bath are other misleading factors. A similar current regulating system using the current drain as the basis for the regulation of the depth of immersion is also known, but it has the same disadvantages as the voltage-based regulating system described above.

By means of the electrical formation of the quotient of the melting current and voltage and the use of this quotient for the regulation of the depth of immersion a certain decoupling between the melting current input and the depth of immersion can be achieved. This method of forming the measured value represents an improvement over regulation based on voltage alone or current alone, but changes of resistance due to the diminishing electrode length are still misleading factors.

German "Auslegeschrift" No. 1,540,879 has disclosed a method for the regulation of the distance between the electrode tip and the surface of the metal bath in electrical reduction furnaces, in which, however, the absolute depth of immersion of the electrode into the slag layer is not involved. As it has been stated in the beginning, however, the depth of immersion into the slag layer is of decided importance in the shaping of the tip of the electrode, and the geometrical shape of the tip of the electrode influences to a marked degree the magnitude of the differential quotient used for regulation in the known method, especially because it changes with the passage of time. For this reason the previously known method is usable only for the permanent electrodes described therein. In the case of melting electrodes with a constantly varying electrode tip shape the previously known method is not applicable because there is no unequivocal relationship between the magnitude of the differential quotient and the depth of electrode immersion under all conditions of operation. A method of detecting the position of the tip of the electrode based on the determination of the differential quotient along would consequently lead to errors such as would preclude any regulation of the depth of immersion within the optimum range. This situation will be further explained below with the aid of the graphic representation in FIG. 1.

The invention is therefore addressed to the problem of devising a regulating system of the initially described kind in which an automatic compensation is achieved of the various effects of the shape of the tip of the electrode on the measured value or values.

The solution of the problem is achieved in the initially described system in accordance with the present invention in that the signal of the variation of the resistance upon the spatial displacement of the end of the electrode is additionally relayed to the electrode drive regulating means as a corrective magnitude.

The invention thus consists in the common input to the electrode drive regulating means of the absolute value of the resistance and the differential quotient of the resistance and the change in position of the end of the electrode. Thus a clear distinction is made between a diminishing resistance which is to be attributed, for example, to an insufficient depth of the slag layer, and a diminishing resistance which is to be attributed, for example, to an excessive depth of immersion or to an excessively slender end on the melting electrode. Additional advantages will be given in the special description, in connection with the drawings.

One especially advantageous embodiment, in accordance with the further invention, is characterized in that the system for measuring the change in resistance consists of a series circuit of a divider for the melting current and the melting voltage, a differentiating circuit for forming the derivative "$dR/dt$", and another divider to which a signal proportional to the rotatory speed of the electrode drive is additionally relayed for the formation of the quotient. Here "R" represents the bath resistance of the slag and "$t$" the time. The influence of the resistances within the rest of the current paths will for the present be considered as negligible. The rotatory speed of the electrode drive corresponds to the rate of change of position, i.e., to the differential quotient of the distance covered by the electrode and the time during which it moves, and it can be picked up in an especially simple manner by means of a tachogenerator which is associated with the motor that drives the melting electrode.

An example of the embodiment of the invention and its manner of operation will be further described hereinbelow with the aid of FIGS. 1 to 3.

Figure 2:
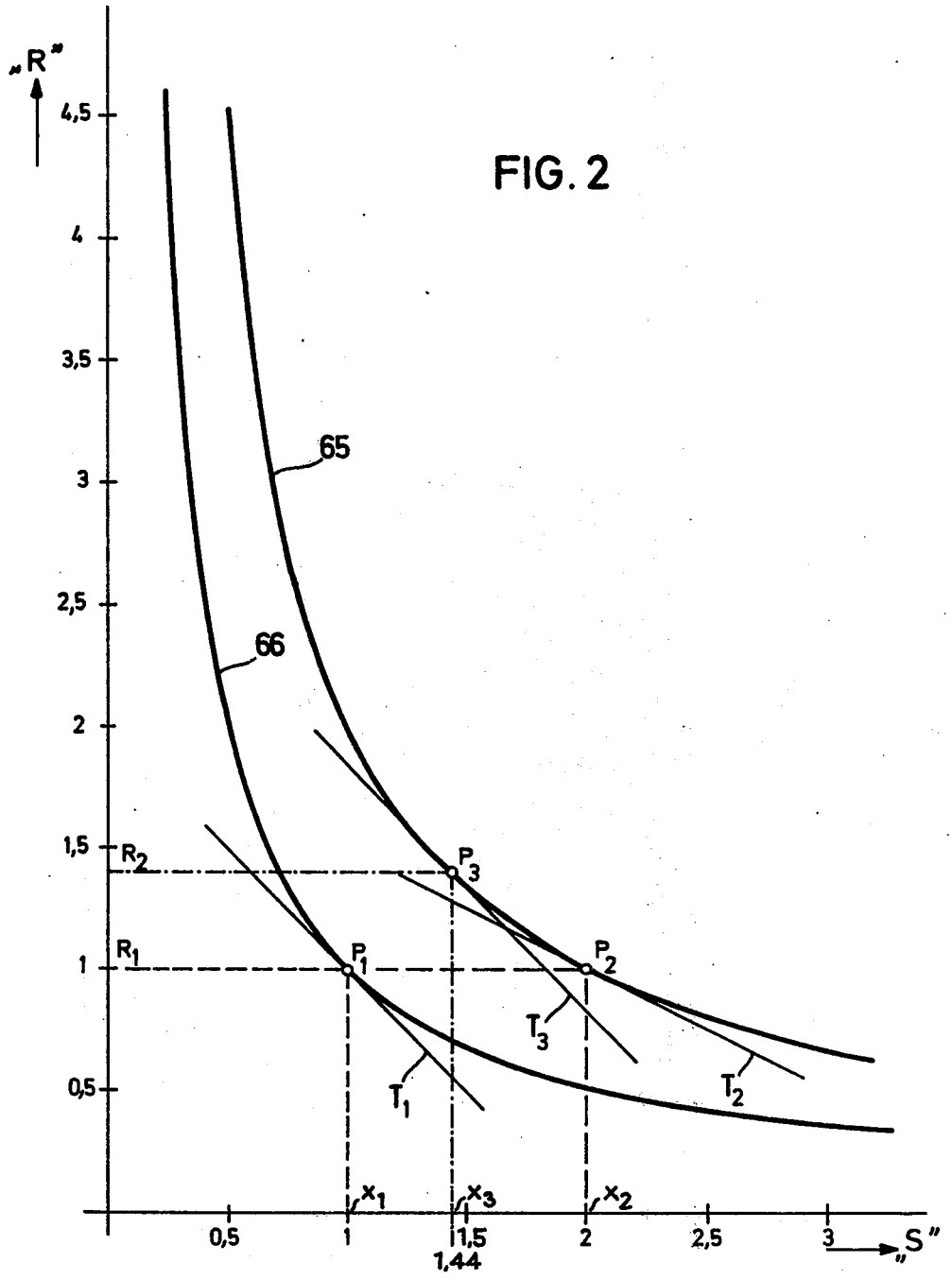
Figure 3:
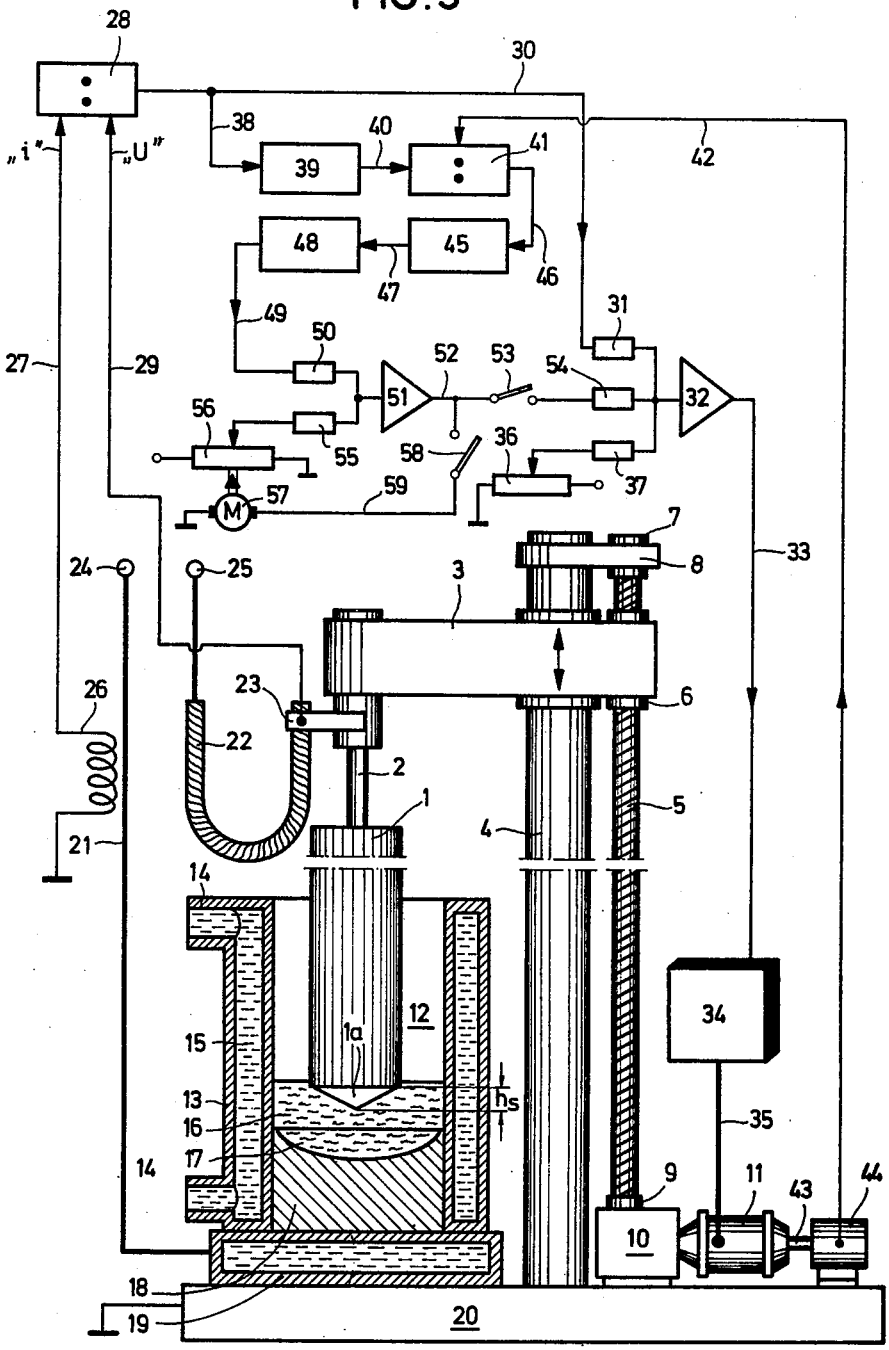

FIG. 1 illustrates so-called "immersion curves" in a parametric representation, i.e., the variations in the system resistance for various electrode tip lengths and various slag bath depths, FIG. 2 gives two "immersion curves" for two specific states of the slag bath at two different temperatures, and FIG. 3 is a side elevational view, partially in longitudinal cross section through a conventional electrical slag remelting apparatus with a control system in accordance with the invention.

FIG. 1 presents a diagram on whose abscissa is plotted the depth of immersion "s" of the end of the electrode in millimeters, while the ohmic resistance between the electrode clamp and the crucible terminal is given in microohms on the ordinate. The latter value is not only the ohmic resistance of the slag layer, but inevitably contains also the resistances in the electrical terminals and parts of the apparatus. The resistance is therefore referred to as the system resistance. The sets of curves show the variations of the system resistance as the immersion depth varies between about 10 mm and 250 mm. The set of curves on the left, consisting of three, applies to a melting electrode tip length "$h_s$" of 50 mm, the middle set to a tip length of 100 mm, and the right-hand set to a tip length of 150 mm. The left or bottom curve in each set applies to a slag bed depth of 200 mm, the middle curve to a slag bed depth of 225 mm, and the right or top curve to a slag bed depth of 250 mm. It can clearly be seen that the tip length of the electrode has a considerable influence on the system resistance precisely in the technically important immersion depth range between about 20 and 80 mm.

As an aid in comprehension, the following relationships will be explained in detail:

Knowledge of the "depth of immersion curve" $R = f(s)$ is important for the design and operation not only of the electrode advancement control but also of the power supply. As FIG. 1 shows, the system resistance "R" drops more or less steeply, depending on the tip length "$h_s$", as the depth of immersion increases. The fact that the time constant of the furnace control circuit can vary considerably according to the preselected electrode immersion depth or according to variations of the immersion depth must be given special attention in the adjustment of the controller in regulated-current power supplies.

On account of the nonlinear relationship between the system resistance "R" and the immersion depth "s", there is a considerable change in amplification within this control range. An improvement of the operation of this regulating circuit, however, can be brought about only for certain conditions of operation. For reasons of stability, the steepest portion of the immersion curves has hitherto been taken as the basis, as well as the characteristic curve for smaller tip lengths "$h_s$". For a deeply immersed, large electrode tip, however, this signifies a very imprecise regulation.

The object of an optimum immersion depth regulation, however, is to keep the tip length "$h_s$" of the electrode constant, and thus also the distance between the tip of the electrode and the molten metal bath at a constant slag bed depth H. Only in this manner will there be a complete assurance that, on the one hand, the material will drip down within the slag without contact with the air, and that, on the other hand, a stable production and distribution of heat will be maintained within the slag bath.

In the immersion curves of FIG. 1, basically two different ranges are to be seen, namely the shallow portion of the curves following the immersion of the entire electrode tip, and the steeply rising portion after partial removal of the electrode tip from the slag bath.

If a given value is to be maintained in the bath resistance in the flat part of the immersion curves, it is hardly possible to have an unequivocal association with a specific size "$h_s$" of electrode tip, for at this part of the immersion curves, the amplification of the regulating portion is very low, i.e., for a slight change in the bath resistance there will be a very great change in the depth of immersion $h$ and vice versa. As a result, the unequivocal formation of the tip length "$h_s$" on the electrode when operated on this flat portion of the immersion curves is hardly possible, and this is confirmed by experience.

On the other hand, if a specific bath resistance is to be maintained in the steep part of the immersion curves, the electrode is partially withdrawn. The remainder of the electrode tip left in the slag bath melts away; the length "$h_s$" of the electrode tip thus is reduced. But since according to the immersion curves the smaller electrode tip length "$h_s$" can correspond to the same given bath resistance at a correspondingly shallower immersion depth "$h$", this melting away continues until the end of the electrode is virtually flat. The part of the immersion curve corresponding to this state is very steep, i.e., in the event of extremely small changes in the immersion depth "s", due for example to short regulating movements of the electrode advancement control, great variations will result in the bath resistance. This can be taken as an indication that the end of the electrode is close to the surface of the bath.

It can be stated, therefore, that the regulation of the depth of immersion by the maintenance of a specific bath resistance can hardly be accomplished. A definite maintenance of the desired depth of immersion, however, is achieved by the method of the invention. In this manner the electrode tip can no longer melt away flat, because during the regulating movements of the electrode the rise "$dR/ds$" is determined and is used as a signal for correcting the depth of immersion on the one hand and the size $h_s$ of the electrode tip, on the other. This correcting signal is such that, as the immersion curve becomes steeper it pushes the electrode further into the slag bath and vice versa. The depth of the slag bath can be kept constant by appropriate measures, so as to prevent it from having any influence on the measurements.

In FIG. 3, 1 is a melting electrode made of any desired metal or alloy, which is fastened by means of a rod 2 to a boom 3 of an electrode holding system. The boom 3 is mounted for displacement along a vertical guide column 4 and is movable vertically by means of a threaded spindle 5. For this purpose a spindle nut 6 is provided on the boom 3. The threaded spindle 5 is held at its upper end by a bearing 7 which is affixed by a crosspiece 8 to the guide column 4. The bottom bearing 9 of the threaded spindle is located in a gear case 10 in which the rotatory speed of a drive motor 11 is reduced to an appropriate speed. Parts 2 to 11 constitute the so-called electrode advancing system.

The melting electrode 1 has at least a portion of its length within a chill mould 12 which consists of a chill mould wall 13 in the form of a hollow cylindrical jacket with connections 14 for the input and output of a coolant liquid 15. During the melting phase, in which the apparatus is illustrated, the melting electrode 1 is immersed to a certain, regulated degree into a slag layer 16, while a conical tip 1*a* is formed on the bottom end of the electrode, with a tip length "$h$". By melting away drop by drop, the electrode 1 forms a molten puddle 17 which solidifies into an ingot 18 as the melting progresses. The bottom of the chill mould is closed by a water-cooled floor 19 which rests on a base plate 20 along with the rest of the parts of the installation.

The electric power is delivered on the one hand through a flexible conductor 22 and a terminal clamp 23 to the rod 2, and from there to the electrode 1, and on the other hand it is delivered through a line 21 to the mould floor 19. Often the mould floor 19 is electrically insulated from the chill mould 12 (This is not shown in the drawing). The conductors 21 and 22 are connected by means of terminal clamps 24 and 25 to a power supply system which is not shown. The melting current "*i*" flowing in the system is detached in line 21 by means of a current transformer 26 and relayed through a line 27 to a divider 28. Moreover, the melting voltage is derived from line 22 and conducted by a line 29 also to the divider 28 in which the quotient of the melting voltage and melting current is formed, which represents the system resistance "$R_{ist}$". The output of the divider 28 is relayed through a line 30 to an input resistance 31 of a regulator 32 for regulating the depth of immersion. By means of a potentiometer 36, a predetermined value is set for an additional input resistance 37 of regulator 32, this value being the preselected bath resistance. From the regulator 32 a line 33 leads to a control circuit 34 which is connected by a line 35 to the drive motor 11 in the electrode advancing mechanism. In this manner, a purely resistance-dependent regulation of the depth of immersion of electrode 1 into the slag layer 16 is accomplished.

From the divider 28 another line 38 runs to a differentiating circuit 39 for the formation of the differential "*dR/dt*", whose output is relayed through a line 40 to a divider 41. Also fed to the divider 41 through a line 42 is a voltage which corresponds to the speed of movement of the electrode or the differential quotient "*ds/dt*". Since this magnitude in turn corresponds to the rotatory speed of the motor 11, a tachogenerator 44 is associated with the motor by means of a shaft 43 and supplies a voltage proportional to the rotatory speed. In the divider 41, the derivative "*dR/dt*" and the derivative "*ds/dt*" are used to form the quotient "*dR/ds*", i.e., the change of the resistance in relation to the spatial displacement of the electrode. In a circuit 45 there is formed the absolute value of the differential quotient "*dR/ds*". Circuit 45 is connected to the divider 41 through a line 46. From the circuit 45 a line 47 runs to a circuit 48 in which the average value of the differential quotient is formed. Through a line 49 this average value is fed to an input resistance 50 of a regulator 51 whose output is relayed through a conductor 52 and a switch 53 to an input resistance 54 of the regulator 32 where it is algebraically summed with the other inputs of regulator 32 whereupon the output of regulator 32 yields $R + dR/ds$. The switch 53 is closed during the fully automatic operation of the regulator, but is can be opened when the apparatus is started up and during manual intervention. A preset value, which corresponds to the optimum value of the differential quotient "*dR/ds*", is fed through an input resistance 55 to the regulator 51. This preset value is adjusted at a potentiometer 56 which is a motorized potentiometer driven by a motor 57. This motorized potentiometer permits a gradual setting of the amount of the correction. This setting is performed by closing a switch 58 in a line 59 leading to the output of regulator 51.

The changeover to regulation with correction is accomplished by then reopening switch 58 while at the same time closing switch 53. A gradual transition then takes place, since the preset value at the output of potentiometer 56 at the moment of switching is equal to the value actually present in line 49.

The operation of the regulating system will now be explained further with the aid of an example illustrating another advantage of the method of the invention. The additional advantage consists in the fact that the immersion depth regulation is also insensitive to variations of the specific resistance of the slag due to temperature variations. FIG. 2 is intended to show this. In this figure, the relationship between the bath resistance and system resistance "R" on the one hand and the depth of immersion "*s*" on the other is represented, using imaginary numerical values. The immersion curve 65 differs from curve 66 by a change in the factor P of, for example, 2. Let point $P_1$ be established as the working point, with the corresponding resistance value $R_1$ and the tangent gradient T*s*. Now, if the resistance of the slag bath is increased by the cooling thereof, by the factor 2 for example, the immersion curve 65 will apply. The prior-art regulation would now advance the electrode into the bath to such an extent, namely $x_2 = 2$, that the resistance $R_1$ will be re-established. Since, however, the gradient $T_2$ of curve 65 at this working point $P_2$ is lower than at point $P_1$, the regulating system of the invention will withdraw the electrode to the point $P_3$ at which the condition of equal gradient of the tangent $T_3$ will be fulfilled. Whereas the simple regulation of the prior art would have increased the depth of immersion by a factor of 2, the depth of immersion is increased by a factor of only 1.44 through the use of an improved control. In conjunction with a regulated-current power supply, this means that the bath power is increased. In the case of an unregulated power supply with constant voltage, the bath power is decreased.

Increasing the bath power in a regulated-current system is advantageous especially when the increase in the resistance results from a cooling of the slag, because the increased bath power increases the temperature of the slag again and the bath resistance diminishes. In the case of the unregulated power supply, this would result in a further cooling of the slag bath, unless a correction is made from outside the system.

I claim:

1. Apparatus for the continuous and automatic regulation of the depth of immersion of a driven remelting electrode in the slag layer of an electroslag remelting furnace, comprising regulating means for maintaining the depth of immersion essentially constant at a predetermined value, including first circuit means for detecting the actual resistance of the current-path through the slag layer and for producing a first signal corresponding to the actual resistance, and second circuit means for detecting the changing of the resistance upon the spatial displacement of the electrode within the slag layer and for producing a second signal defining a correction signal corresponding to the changing of the resistance and means receptive of the first signal corresponding to the actual resistance from the said first circuit means and the second signal from the second circuit means for algebraically summing the two and responsive to the sum for controlling the driving of remelting electrode to effect immersion thereof to a depth wherein the said second signal corresponding to the changing of the resistance is essentially constant whereby the electrode is remelted to form a solid ingot beneath the slag.

2. The apparatus according to claim 1, wherein the first circuit means comprises a first divider receptive of the melting voltage, and the second circuit means comprises a differentiating circuit receptive of the first signal and a second divider receptive of a signal proportional to the speed of the electrode drive and the output of the first divider.

* * * * *